United States Patent [19]

Heilbrun

[11] 4,355,633

[45] Oct. 26, 1982

[54] ADJUSTABLE MULTI-FUNCTION ROTARY EXERCISE APPARATUS

[76] Inventor: Harold Heilbrun, P.O. Box 397, Scottsbluff, Nebr. 69361

[21] Appl. No.: 175,471

[22] Filed: Aug. 5, 1980

[51] Int. Cl.[3] ..... A61H 1/02

[52] U.S. Cl. ..... 128/25 R; 272/116; 272/112; 272/125; 272/128; 128/75

[58] Field of Search ..... 272/93, 96, 73, 117, 272/116; 128/25 R, 24 R, 25 B

[56] References Cited

U.S. PATENT DOCUMENTS 2,648,330 8/1953 Clark ..... 128/25 R 4,225,130 9/1980 Zimmerman ..... 272/73

*Primary Examiner*—Richard C. Pinkham

*Assistant Examiner*—William R. Browne

*Attorney, Agent, or Firm*—David H. Hill

[57] ABSTRACT

An adjustable multi-function exercise apparatus having a base and a pair of rigid spaced interconnected upstanding support "A" frames for pivotally positioning a longitudinal frame a fixed distance from the base; the pivotal long frame and upstanding supporting "A" frames being so designed as to provide for adjustable positioning of the pivotal frame to a desired fixed position. The longitudinal frame being open at one end for a pair of spaced rotatable plates. The plates are diagonally, multi-apertured for selectively receiving hand grips. The spaced rotatable plates are selectively driven by a variable speed drive, permitting variable multiple functional use of the exercising apparatus.

9 Claims, 16 Drawing Figures

100
102
104
106
108
110
112
114
116
118
120
122
124
126
128
130
132
134
136
138
140
142
144
146
150
152
154
178
180
190
192
194
196

198
200
202
204
206

ADJUSTABLE MULTI-FUNCTION ROTARY EXERCISE APPARATUS

FIELD OF THE INVENTION

This invention pertains generally to exercise and therapeutic apparatus, and more particularly to a multi-function adjustable apparatus of this type.

DESCRIPTION OF THE PRIOR ART

The prior art contains many examples of exercise and therapy devices, both motor-driven and otherwise, for exercising or conducting specific therapy movements of one or another set of muscles of the body of the user or patient. Examples of the prior patented art includes U.S. Pat. Nos. 3,455,295 Kellogg, 3,895,623 Mahlandt, 3,876,198 Seligman, 2,892,455 Hutton and 3,724,450 Chaitin. The apparatus of each of these patents serves a specific need, and in many cases that need pertains to only a limited portion of the body of the user. Also, in many instances the devices of the prior art are unnecessarily complicated in both their construction and use, while at the same time affording fewer than desirable options as to operation and, accordingly, conditions of less than desirable flexibility in use.

SUMMARY OF THE INVENTION

The present invention overcomes the drawbacks of known exercise devices and for the first time provides a multi-use exercise apparatus which can be employed for multiple usage by adjustment, thereby providing exercising of the entire body within a short period of time. The adjustability features provide for manipulation of the arms and torso of the upper body when employed by the individual in the upright or standing position by selective positioning of the hand grips in various positions. This simultaneously permits exercise of the lower torso by jogging or by raising the legs from ground contact and suspending the body from the hand grips and stretching the arms and torso while in the suspended position. In accomplishing this result, the rotary exerciser provides for manipulation and stretching of the entire body and simultaneously tones-up unused and neglected muscles while increasing circulation to the entire body. Therapeutic manipulation is also provided for the disabled, such as wheel chair patients, for eliminating atrophy of muscles and circulatory system since the rotary exerciser may be adjusted to the correct position of the seated person, and exercise provided may be provided for the unaffected parts of the body.

Disengageable variable speed drive provides for elective rotation of the hand grips, depending on individual needs, so that varying degrees of exercise may be provided.

Other and additional advantages and features of the invention become more readily apparent from the following detailed of preferred embodiments thereof when taken together with the accompanying drawings in which:

BRIEF DESCRIPTION OF THE DRAWINGS

FIG. 16 is an exploded perspective view of a modified form of rotary member showing a hand grip for elective position on the rotor.

DESCRIPTION OF THE PREFERRED EMBODIMENT

Figure 1:
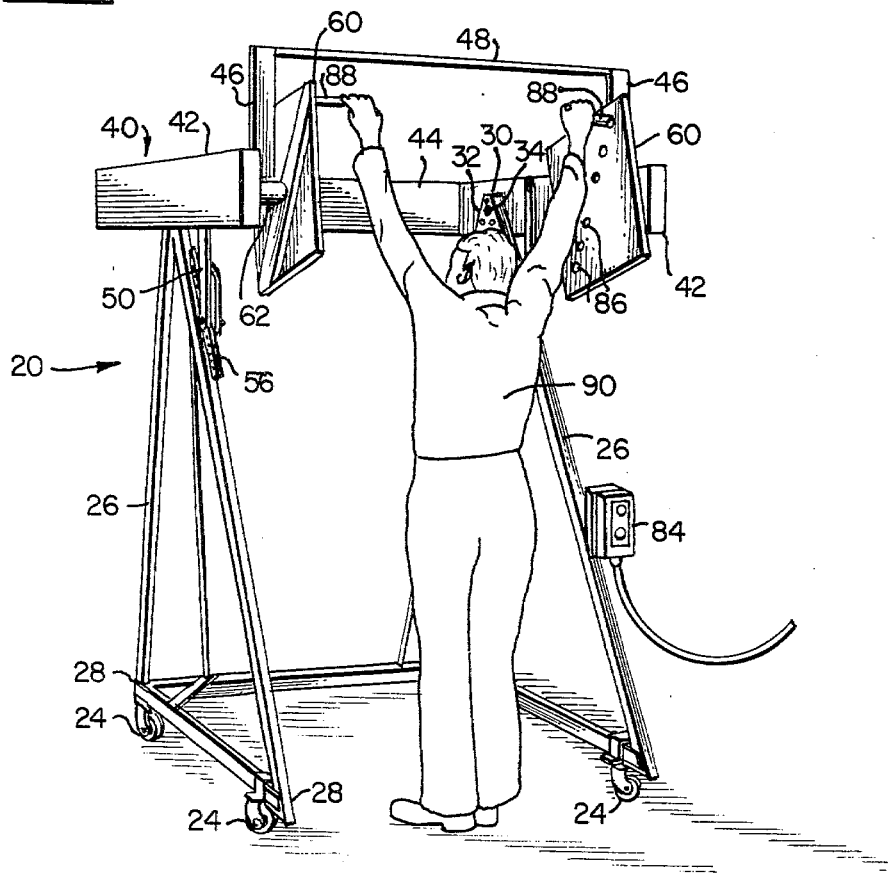
FIG. 1 is a perspective view of the present invention employed for exercising while in the standing position.
Figure 2:
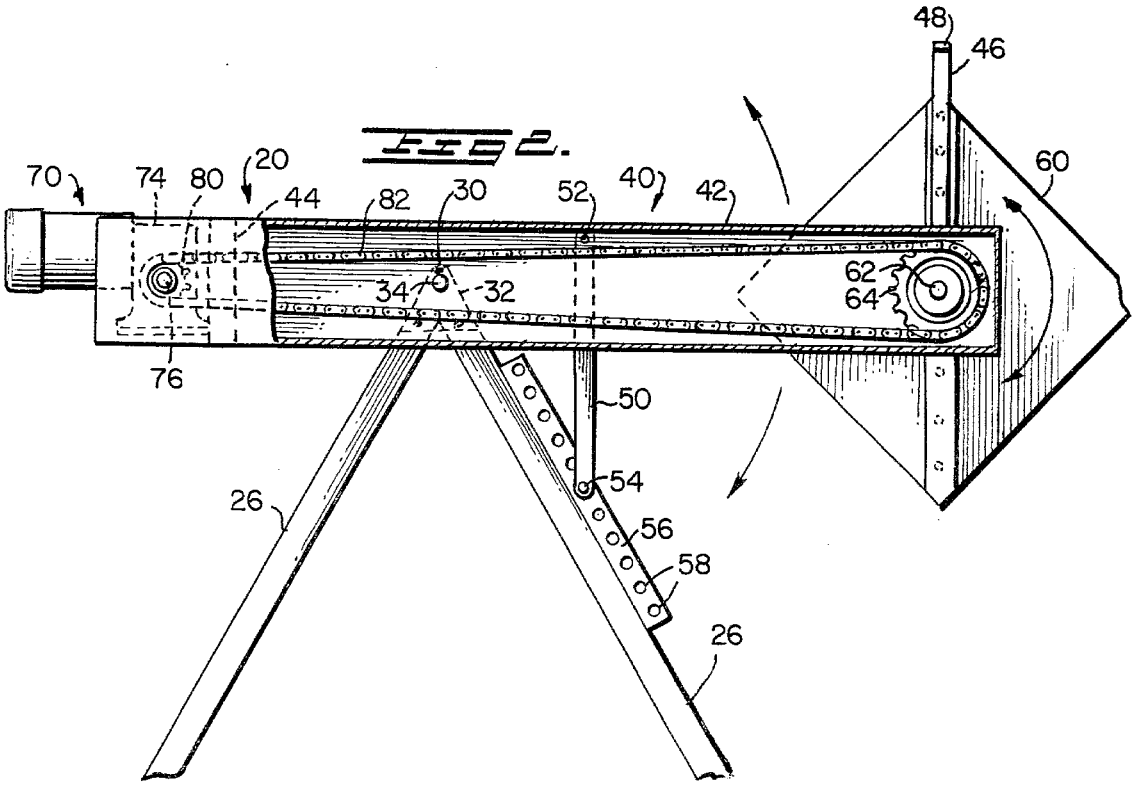
FIG. 2 is a side elevational view of the upper portion of the invention partially broken away and showing the drive means.
Figure 3:
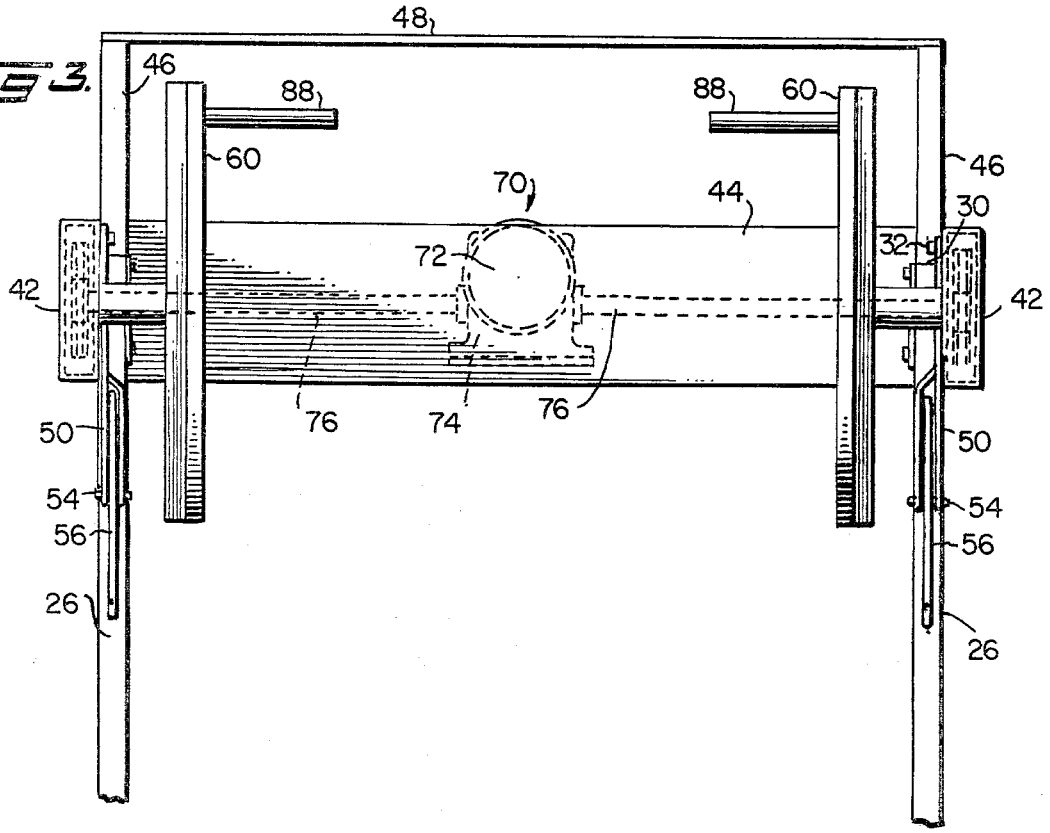
FIG. 3 is a front elevational view of the components shown in FIG. 2.

Referring now in more detail to the drawings and in particular to FIGS. 1–8, the exercise apparatus is generally indicated by the reference numeral 20, having a base 22 provided with lockable caster wheels 24 to permit and facilitate positioning of the exercise apparatus 20 for use or storage. A pair of vertically extending "A" frame members 26 are secured at their lower ends to the base 22 as at 28 and extend upwardly and inwardly and converge as at 30, a suitable distance from the base 22. The upper converged portions 30 of the "A" frames 26 are provided with reinforcing gusset plates 32 securely fixed to each side of the "A" frames 26. The gusset plates 32 provide for the previously mentioned reinforcement and also suitable mounting plates for stub shafts 34 which extend outwardly of the "A" frames and form rotatable support means for a longitudinal rotatable frame 40, as best viewed in FIGS. 1 and 2. The longitudinal rotatable frame 40 comprises a pair of side rails 42 and a transverse connecting web 44 approximate the rear end of the rails 42. A pair of upstanding brackets 46, securely fixed to the inner forward portions of the rails 42 are connected at their upper ends to a transverse member 48, thus forming a rigid boxlike structure comprising the longitudinal rotatable frame 40. Fixed positioning of the rotatable frame 40 is provided by means of rotatable links 50, secured at their upper end by pins 52, and fastened to the inner faces of the side rails 42. The rotatable links 50 are located forwardly on the converging ends 30 of "A" frames 26 and depend downwardly and are connected at their lower ends by pins 54, to a multi-apertured upstanding plate 56 fixedly secured to the faces of the converging "A" frame members 26 (FIGS. 1, 2 and 3). From the foregoing it will be understood that the pivotal longitudinal frame 40 may be selectively positioned by means of the positioning links 50, to a raised or lowered position by inserting the pins 54 through one of the selected apertures 58 of the plates 56.

A pair of rotatable plates 60 are journaled substantially adjacent the side rails 42 at their forward ends for rotation thereon. Said journals comprise a pair of stub shafts 62 welded or otherwise secured to the outer faces of the rotatable plates 60, and extended outwardly and journaled for rotation within the side rails 42. The outer ends of the stub shafts 62 are provided with sprockets 64 fixedly secured thereto, within the side rails 42 as best seen in FIG. 2.

Figure 4:
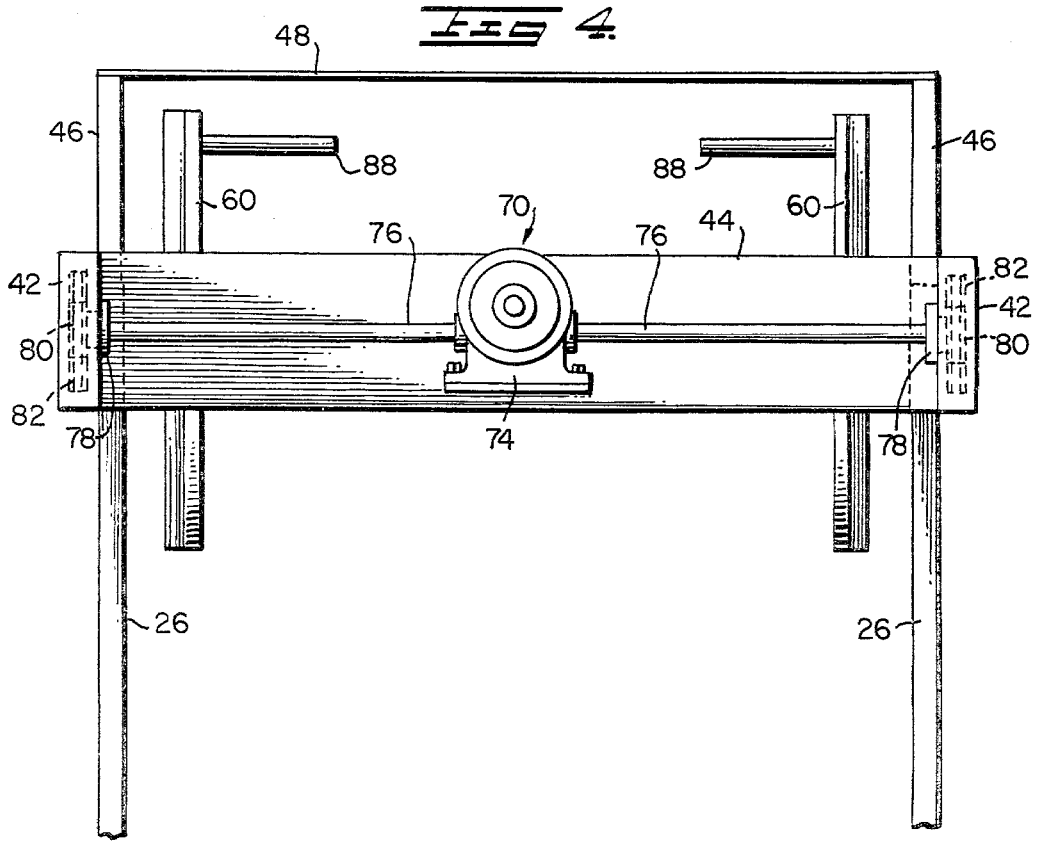
FIG. 4 is a rear elevational view of the components shown in FIG. 2.
Figure 5:
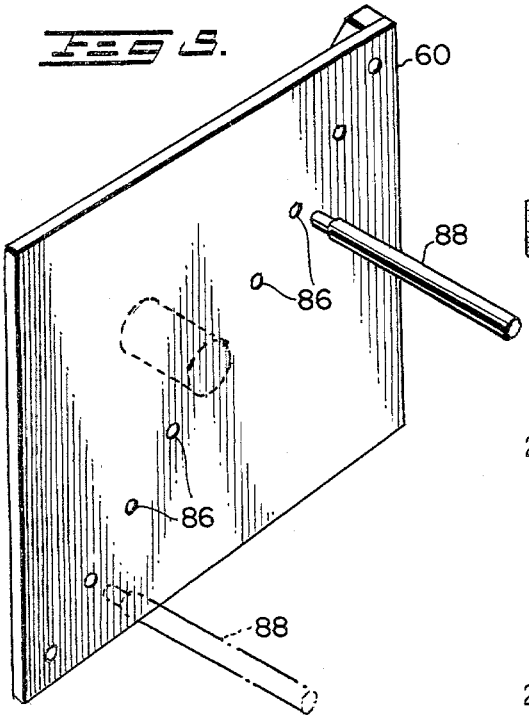
FIG. 5 is an exploded perspective view of one of the rotatable plates showing a hand grip in position for elective insertion in apertures within the plate face.

Referring now more particularly to FIGS. 2, 3 and 4, a drive means indicated generally by the reference numeral 70, is securely mounted medially of the transverse web 44 of the longitudinal frame 40 and comprises a drive motor 72 and gear reduction unit 74 and having a disengaging clutch (not shown) provided therein. A pair of rotatable shafts 76 extend outwardly from the gear reduction unit 74, and are suitably journaled at their outer ends as at 78 to the side rail members 42 and extend inwardly of said side rails and are provided with a pair of sprockets 80 at their ends, and fixedly secured thereto. A pair of drive chains 82 impart rotation of the stub shafts 62 by means of the previously described sprockets 80 and 64 (FIG. 2).

Figure 6:
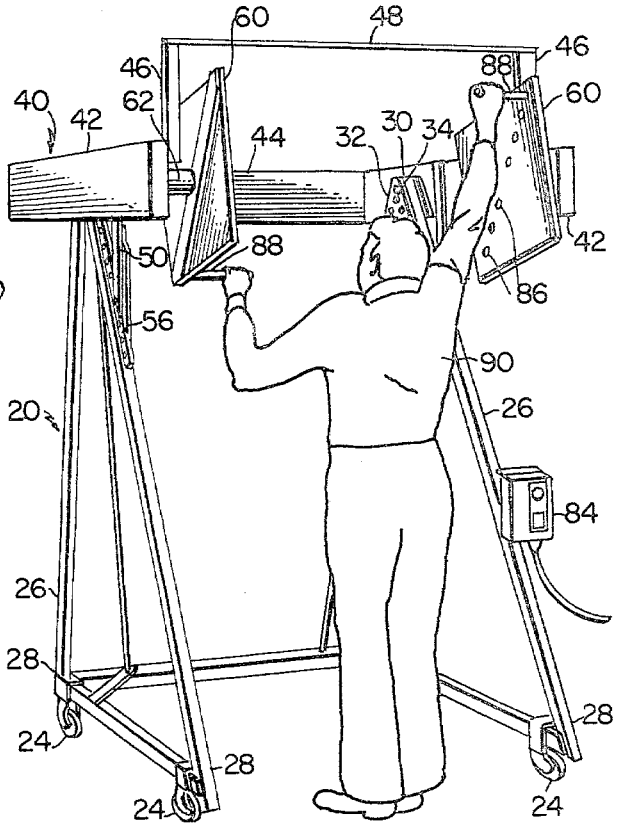
FIG. 6 is a perspective view similar to FIG. 1 showing the hand grips employed in varied positions for effective exercise results.

Referring now more particularly to FIGS. 1 and 6, an electrical control box is provided and mounted to one of the upstanding "A" frame members 26 for easy accessibility and usage. The electrical control box 84 effects speed control of the electric motor 72 along with the previously described clutching and declutching of the drive means within the reduction unit 74, thus governing the synchronous speed of rotation of the plates 60.

The plates 60 are provided with diagonally spaced apertures 86 within their inner faces to selectively receive a pair of hand grips 88. The individual exerciser 90 (FIGS. 1, 6, 7 and 8), selects the position of his choice and places the hand grips or pegs 88 in their desired apertures 86 and controls the exercising apparatus through electrical control unit 84 and effectively accomplishes the desired exercises. If the individual desires to impart rotation of the plates 60 himself, he simply declutches the motor 70 by means of the control box 84 and powers the unit himself.

Figure 7:
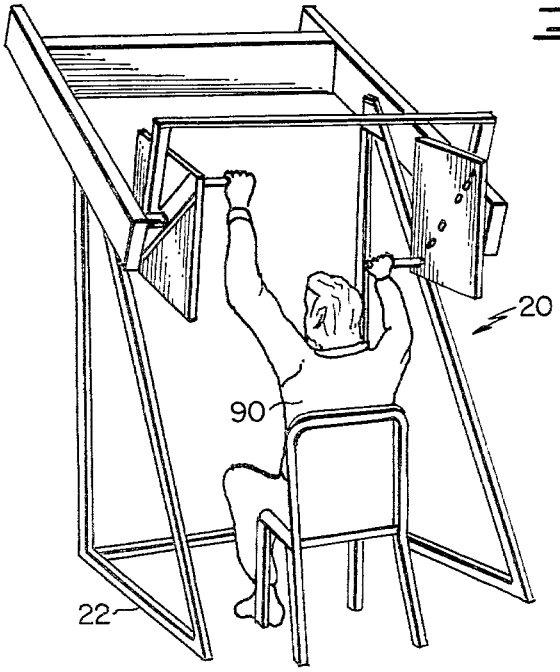
FIG. 7 is a perspective view of the exercise apparatus adjusted for employment in the sitting position.

The exercising apparatus is distinctly beneficial for therapeutic usage for wheel chair patients since the apparatus can be adjusted to a position as best seen in FIG. 7 where the patient is seated and may exercise unaffected body parts, thereby preventing atrophy while increasing circulation to the body, heart and lungs.

Figure 8:
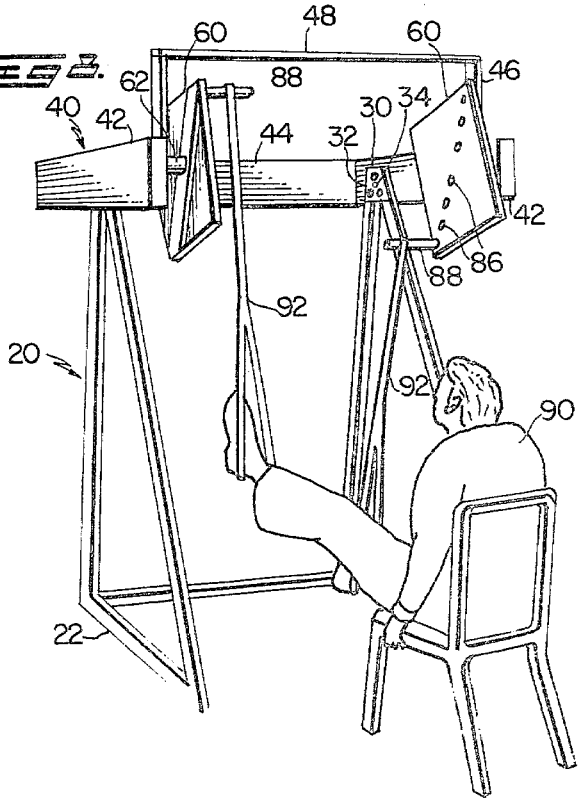
FIG. 8 is a perspective view of the exercise apparatus in yet another position for exercise of the legs while in the sitting position.
Figure 9:
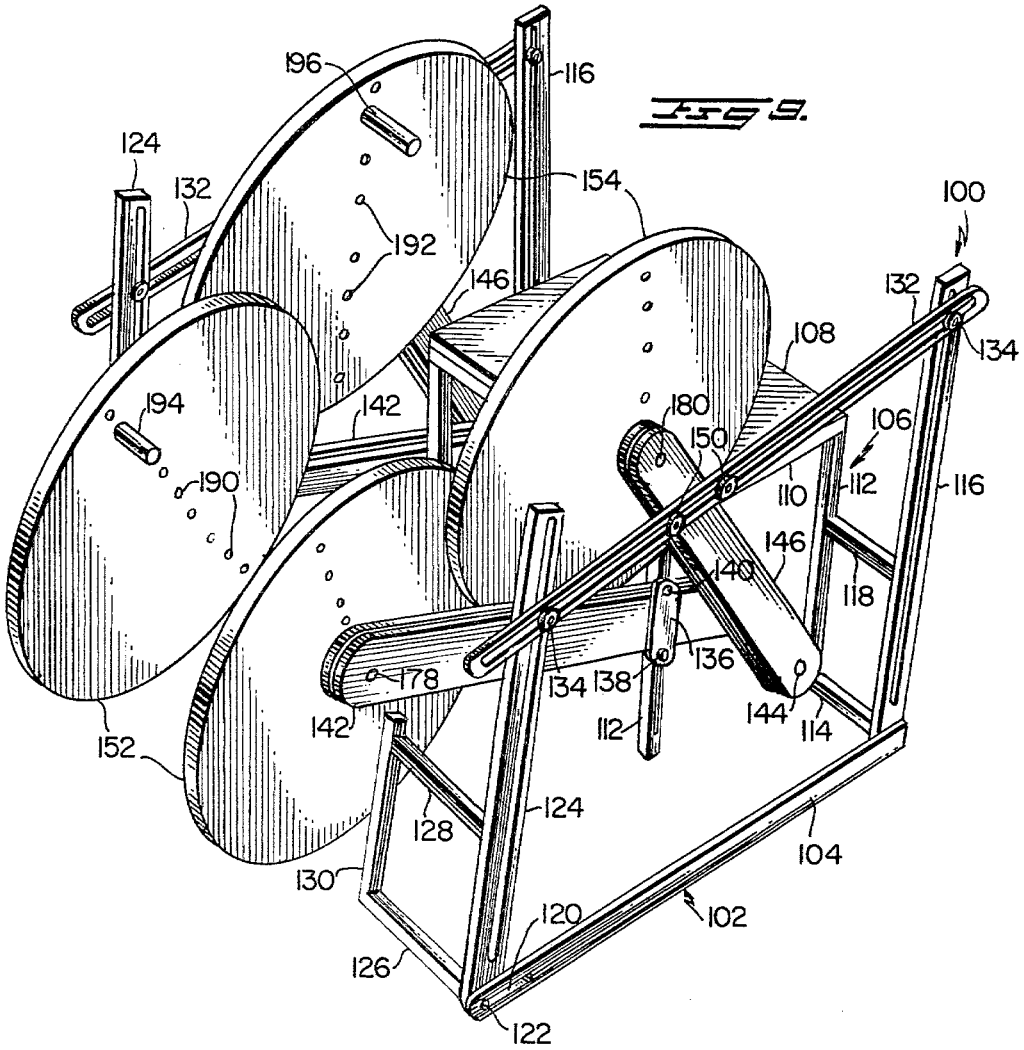
FIG. 9 is a modified form of an exercise apparatus.

Referring now more particularly to FIG. 8, a seated individual exerciser 90 may exercise his legs by employment of a pair of straps 92 which are secured to the pegs or hand grips 88 and depend downwardly to form a sling which supports the legs of the individual and rotation of the plates 60 imparts reciprocal movement to the legs.

Referring now more particularly to FIGS. 9-16, a modified form of an exercising device is shown and is generally indicated by the reference numeral 100. The exercise unit 100 comprises a base, generally designated at 102, having longitudinal side rails 104 and a transverse connecting unit at one end and generally indicated by the reference numeral 106. The transverse connecting unit 106 provides a seat 108 for an individual exerciser to sit on while exercising. The seat 108 rests on a rectangular platform 110 and has vertical legs 112 for ground engagement. The rearmost legs 112 are connected to the longitudinal side rails 104 by means of struts 114, thus forming a rigid base and seating structure. Adjacent the rear of the longitudinal members 104 a pair of upstanding slotted rails 116 are maintained in vertical alignment by means of struts 118 securely fixed medially of the vertical legs 112 of the seat 108 and at their opposite ends to the upstanding slotted rails 116 substantially medially thereof. The lower ends of the upstanding slotted rails 116 are fixedly secured to the longitudinal side rails 104 and struts 114, thus forming a rigid base, seat and vertical side rail unit. The side rails 104 are slotted as at 120 to receive bolts 122 secured to forward upstanding slotted rails 124, said bolts 122 permitting pivotal movement to the vertical rails 124. Inwardly extending struts 126 and 128 are secured to a foreshortened vertical strut 130 to provide steady alignment to the slotted vertical rails 124. The rear slotted vertical rails 116 and forward vertical slotted rails 124 are interconnected by a pair of slotted rails 132, which are secured to the vertical rails by means of bolts 134. The forward legs 112 of the seat 108 are slotted to provide a securement means for a keeper 136, secured to the slotted legs 112 by means of bolts 138 and 140. The keeper 136 constitutes a nest for a slidable and pivotal pair of arms 142, the purpose and function of which will hereinafter be described. The rearmost end of the arms 142 are pivotally connected to a transverse shaft 144 which also serves as a lower pivot for a pair of angularly disposed upstanding arms 146. The upper ends of the arms 146 are securely positioned with respect to the slotted rails 132 by a keeper which forms a nest for the arms 146. This keeper is secured to the slots of rails 132 by means of bolts 150. The transverse shaft 144 interconnects the pairs of arms 142 and 146 and provides uniform alignment of the spaced arms on either side of the seat 108 and coincidentally provides a drive means to a forward and lower pair of discs 152, and at the same time to a pair of upper and rearward discs 154 which is hereinafter described.

Figure 10:
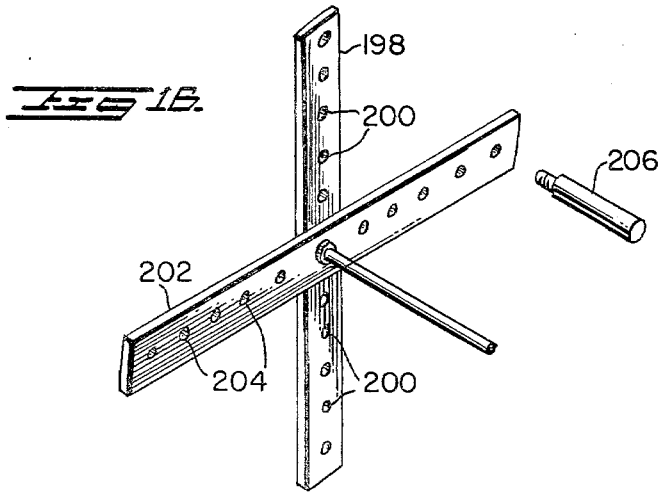
FIG. 10 is a side elevational view of FIG. 9 also showing the exercise apparatus positioned in adjustment, in phantom line.
Figure 10:
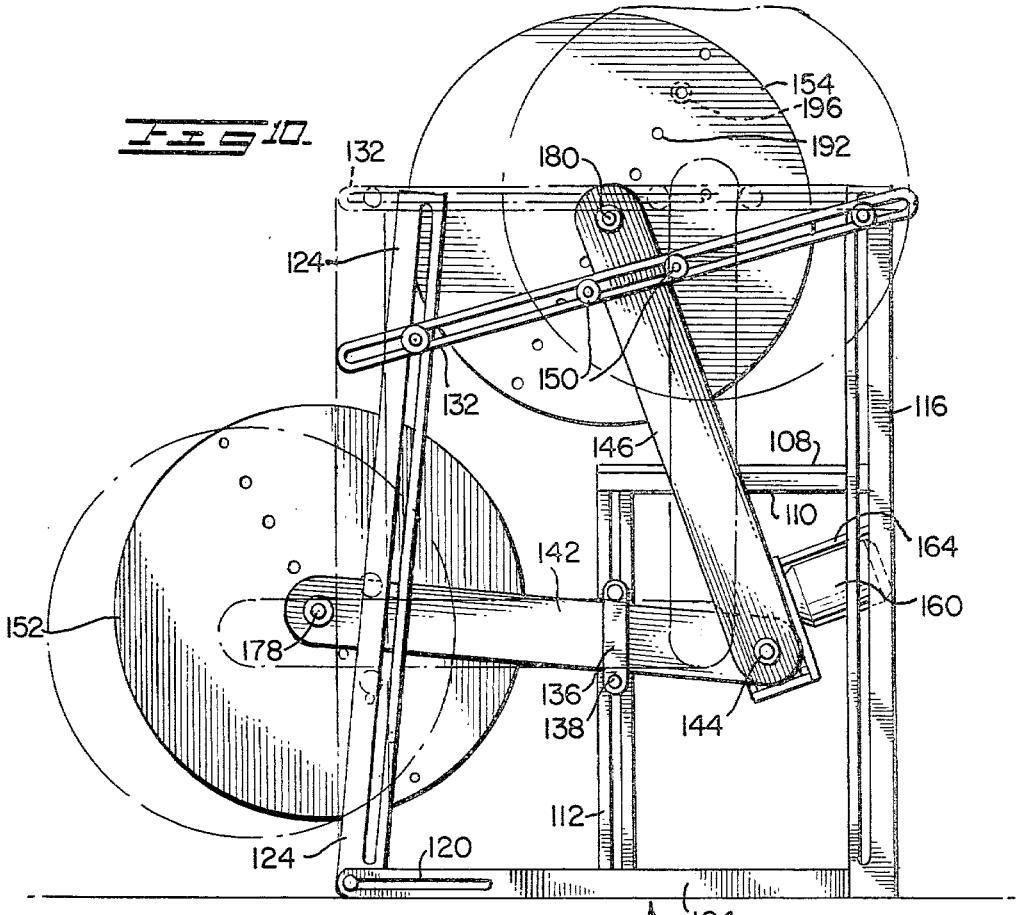
Figure 11:
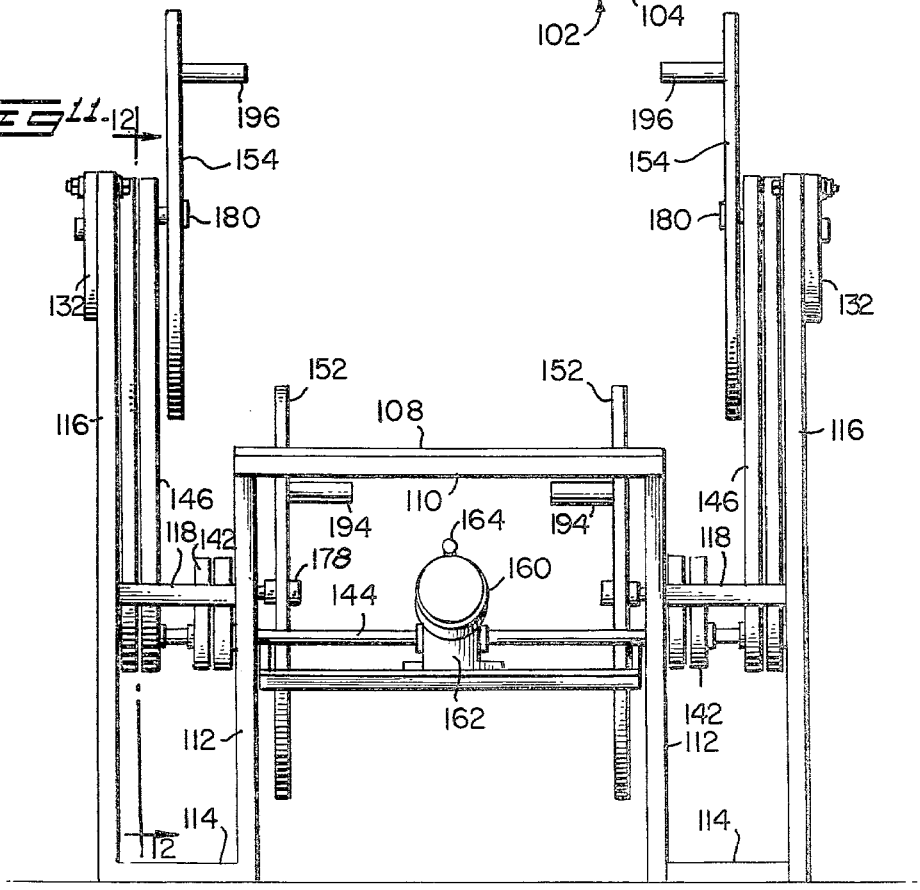
FIG. 11 is a rear elevational view of FIG. 9, with several of the frontal members being omitted, for clarity.
Figure 12:
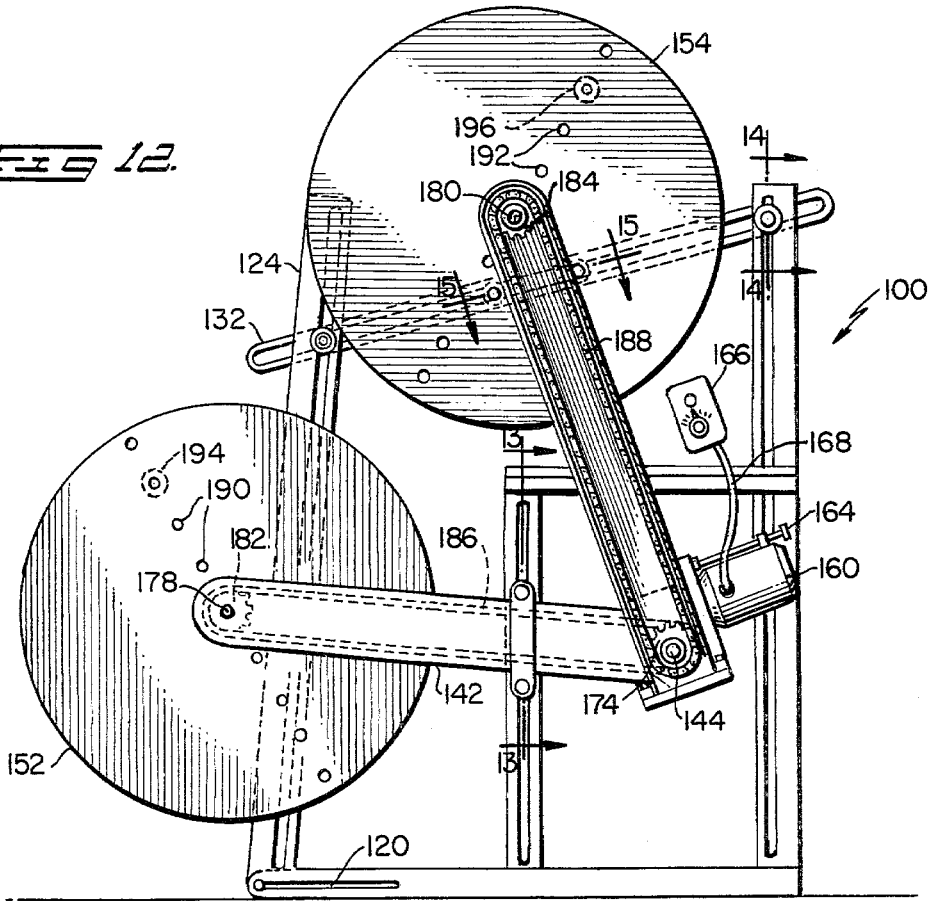
FIG. 12 is a vertical sectional view taken along the line 12—12 of FIG. 11, showing the elective drive.
Figure 13:
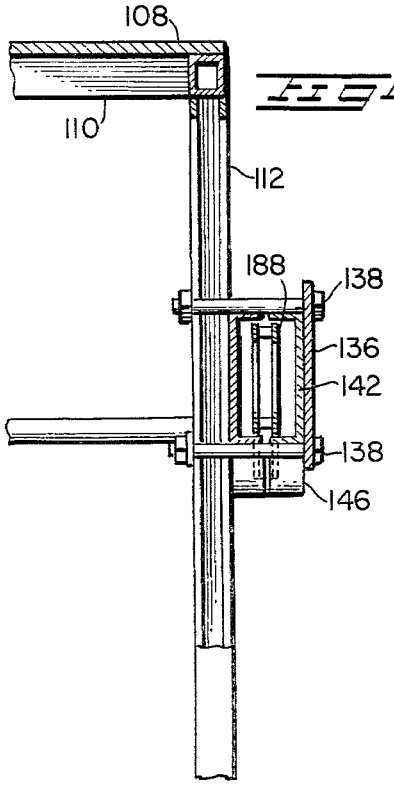
FIG. 13 is a vertical fragmentary detailed sectional view taken along the line 13—13 of FIG. 12.
Figure 14:
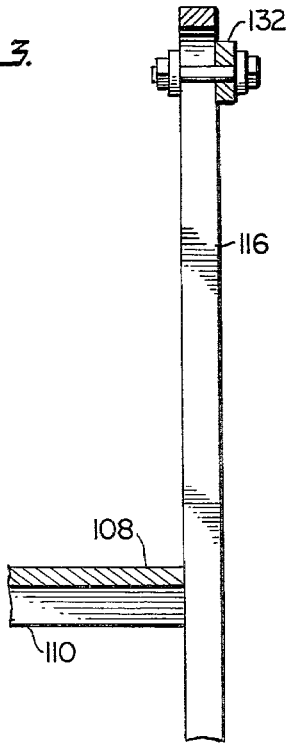
FIG. 14 is an enlarged detailed fragmentary sectional view taken along the line 14—14 of FIG. 12.
Figure 15:
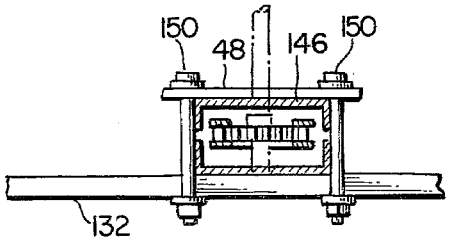
FIG. 15 is an enlarged detailed fragmentary sectional view taken along the line 15—15 of FIG. 12.

Referring now more particularly to FIGS. 10, 11 and 12, the previously described transverse shaft 144 which serves as a pivot for arms 142 and 146 (at each end of shaft 144) also provides a variable speed rotation by means of motor 160 through gear reduction unit 162, said drive means also being provided with a declutching lever 164. The speed of rotation of the shaft 144 is governed by an electrical control box 166 connected to the motor 160 by a flexible electric cable 168. The control box 166 is accessible to the exercising person or attendant. The outer ends of the drive shaft 144 are journaled to the two pairs of arms 142 and 146, and at each end of shaft 144 and sprockets (such as 174, in FIG. 12) are securely fixed to the shaft and housed within the two pairs of arms 142 and 146. The two pairs of discs 152 and 154 are provided on their outer ends with stub shafts such as 178 and 180 (FIGS. 9, 10 and 12) securely fixed thereto. The outer ends of the stub shafts 178 and 180 are journaled to the pairs of arms 142 and 146 and are provided with sprockets such as 182 and 184 on their outer ends and within the confines of the pairs of arms 142 and 146. Rotation of the discs 152 and 154 is provided by means of drive chains 186 and 188 trained about the pairs of sprockets 182 and 184. It will be seen from the foregoing description that an exercising individual imparts selective rotation of the discs 152 and 154 through the variable speed control box 166 to the motor 160 and gear reduction unit 162 to the drive shaft 144 and associated drive sprockets and chains. The discs 152 and 154 are provided with a plurality of spaced apertures 190 and 192 for foot pegs or foot supports 194 and hand pegs or grips 196, selectively positioned in apertures 190 and 192 of the discs 152 and 154.

The slotted rails 104, 116 and 132 provide for selective adjustments for positioning the rotating discs 152 and 154 to satisfy individual needs.

FIG. 16 shows a modified form of rotational exerciser in place of the discs which provides for longitudinal and vertical placement of the hand grips. A vertical arm 198 having apertures 200 and a longitudinal arm 202 having apertures 204, provides for increased different placement of the pegs or hand grips 206.

For total manual operation, the drive means for the discs 152 and 154 may be disengaged by the clutch 164 which permits the free rotation manually of the discs, which act as fly wheels, the weight of which would be determined at the time of manufacture.

From the illustrated and described embodiments of the invention it will be seen that great versatility of exercising apparatus is provided and at the same time providing a completely safe operating unit for all combinations which might be effected.

What is claimed is:

1. An exercise apparatus for physical therapy, muscle rehabilitation and the like, comprising:

a rigid stationary support frame including a pair of substantially parallel spaced-apart A-frame side members between which a patient may stand or sit when operating the machine, a substantially U-shaped pivotal support frame mounted on said stationary support frame medially of said pivotal frame and having means thereon for positively locking said pivotal support frame in a selectable fixed pivotal condition with respect to said stationary support frame, said pivotal support frame including first and second parallel lateral support arms each pivotally mounted at the top of a respective one of said side frame members, and cross-arm means fixedly attached between the open set of proximate ends thereof and interconnecting said support arms for forming a rigid open box for maintaining the support arms in parallel relationship for all positions of said pivotal movement, first and second peg-support members mounted respectively on said first and second support arms for rotation about respective horizontal axes, first and second pegs mounted respectively on said first and second peg-support members at a position spaced from said respective horizontal axes, each said peg extending in a horizontal orientation, an electric motor having a rotary output shaft, and mechanical drive means interconnecting said motor output shaft and each of said first and second rotary peg-support members for effecting rotation of each of the latter.

2. An exercise apparatus for physical therapy, muscle rehabilitation and the like in accordance with claim 1, wherein said first and second peg-support members each includes means for mounting the associated one of said pegs at a selectable distance from the axis of rotation thereof.

3. An exercise apparatus for physical therapy, muscle rehabilitation and the like in accordance with claim 1, wherein said first and second peg-support members each includes means for mounting the associated one of said pegs at a selectable angular position with respect to the rotational position of said rotary peg-support member.

4. An exercise apparatus for physical therapy, muscle rehabilitation and the like in accordance with claim 1, wherein said respective horizontal axes of rotation of said first and second peg-support members are in alignment, constituting a common axis of rotation therefor.

5. An exercise apparatus for physical therapy, muscle rehabilitation and the like in accordance with claim 1, wherein said mechanical drive means effects simultaneous rotation of said first and second peg-support members at a common speed.

6. An exercise apparatus for physical therapy, muscle rehabilitation and the like in accordance with claim 5, and including speed-control means for selectively varying said common speed of rotation of said two peg-support members.

7. An exercise apparatus for physical therapy, muscle rehabilitation and the like in accordance with claim 1, and including a patient-support member connected to said stationary support frame for supporting the patient at a position of access to said peg-support members.

8. An exercise apparatus for physical therapy, muscle rehabilitation and the like in accordance with claim 7, wherein said patient-support member is selectively adjustable relative to said stationary support frame.

9. An exercise apparatus for physical therapy, muscle rehabilitation and the like in accordance with claim 1, and including a second adjustable support frame mounted on said stationary support frame below said first adjustable support frame and in substantial vertical alignment therewith, said second adjustable support frame including third and fourth support arms each pivotally mounted on a respective one of said side frame members for movement in respective planes each parallel to said side frame members, and second cross-arm means fixedly attached to and interconnecting said third and fourth support arms for maintaining the latter in parallel relationship for all positions of said pivotal movement.

* * * * *